United States Patent [19]

Sugawara

[11] Patent Number: 4,850,887

[45] Date of Patent: Jul. 25, 1989

[54] ELECTRICAL CONNECTOR

[75] Inventor: Naoto Sugawara, Sagamihara, Japan

[73] Assignee: Minnesota Mining and Manufacturing Company, St. Paul, Minn.

[21] Appl. No.: 216,076

[22] Filed: Jul. 7, 1988

[51] Int. Cl.[4] ..... H01R 9/07

[52] U.S. Cl. ..... 439/108; 439/497

[58] Field of Search ..... 439/92, 101, 608, 404, 439/405, 422, 497, 108

[56] References Cited

U.S. PATENT DOCUMENTS 4,152,826 5/1979 Mueller ..... 439/92

4,624,515 11/1986 Brush, Jr. et al. ..... 439/608

4,728,299 3/1988 Worth ..... 439/405

4,737,117 4/1988 Lockard ..... 439/92

*Primary Examiner*—Gary F. Paumen

*Attorney, Agent, or Firm*—Donald M. Sell; Walter N. Kirn; John C. Barnes

[57] ABSTRACT

An electrical connector having terminals disposed in a body, which terminals have terminations in one face disposed in two rows and in columns and the terminals have tail portions which protrude from the other face with the terminal ends thereof disposed in a single row and the terminals are disposed to form mirror images about a plane perpendicular to the rows and through a midpoint between terminals to reduce possible cross-talk.

5 Claims, 6 Drawing Sheets

ELECTRICAL CONNECTOR

BACKGROUND OF THE INVENTION

1. Field of the Invention

The present invention relates to an electrical connector, and, more particularly, to an electrical connector having two rows of connecting terminals or contactors, one end of each terminal having a bent and protruding tail portion which is disposed in such a manner that the tail portions as a whole are aligned in a row and at which the electrical connector is connected to a flat cable, in particular, to a flat cable for transmitting high speed pulse signals or those each having a short pulse width between computer mainframes or between a computer mainframe and any of its peripherals.

2. Description of the Prior Art

FIG. 5 of the drawing shows a female connector 1 of the type described above which is used for high speed signal transmitting flat cable.

The connector 1 has two rows of connecting terminals or contactors 2*a*, 2*b*, 2*c*, 2*d*, 3*a*, 3*b*, 3*c*, and 3*d*. Terminals for signal lines 3*a*, 2*b*, 3*c*, and 2*d* and the terminals for ground lines 2*a*, 3*b*, 2*c*, and 3*d* among the two rows of terminals 2*a*, 2*b*, 2*c*, 2*d*, 3*a*, 3*b*, 3*c*, and 3*d* are located alternately or in a zigzag or checkerboard pattern when viewed from a side of the connector 1 to which pins are to be inserted. One end of each of the terminals of connector 1 is connected to a flat cable 4. In FIG. 5, a reference symbol S indicates a signal line terminal, while G designates a ground line terminal. This alternate or checkerboard pattern arrangement of the signal line terminals or the signal lines S and the ground line terminals or the ground lines G is effective to reduce the crosstalk between the signal terminals or the signal lines. In the electrical connector described above, each terminal row is described as having four terminals only for ease and clarification of the explanation. However, it may include five or more, or three or less, terminals.

In the known female connector 1 of the above-described type which is shown in FIGS. 6A, 6B and 7, connecting terminals 101*a*, 101*b*, 101*c*, 101*d*, 102*a*, 102*b*, 102*c*, and 102*d*, which respectively correspond to the connecting terminals 2*a*, 2*b*, 2*c*, 2*d*; 3*a*, 3*b*, 3*c*, and 3*d* of the connector 1 shown in FIG. 5, are each formed of a bent metal sheet 103 hving the same shape. The two rows of terminals are disposed in such a manner that those in one row correspond to those in the other row when they are turned by 180 degrees. In the conventional connector 1, tail portions 106*a*, 107*a*, 106*b*, 107*b*, 106*c*, 107*c*, 106*d*, and 107*d* bendingly protrude from the sides of the respective terminals 102*a*, . . . , 102*d*, 103*a*, . . . , 103*d* at which the terminals are adapted to be connected to an external cable, in such a manner that they are aligned in a row. These tail portions are therefore aligned in the order of G, S, S, G, G, S, S, and G, as shown in FIG. 6.

When the tail portions of the terminals are aligned in the manner shown in FIG. 6, the tail portions for the signal lines are brought adjacent to each other, as in the case of the tail portions 107*a* and 106*b* or the tail portions 107*c* and 106*d*, increasing the possibility of occurrence of the crosstalk of signals to be transmitted through the adjacent respective tail portions.

The present invention is designed to obviate the above-described problem of crosstalk, and an object thereof is to provide an electrical connector which is so improved as to reduce the possibility of occurrence of crosstalk between the tail portions at which the terminals are connected to an external cable.

SUMMARY OF THE INVENTION

The above-described object is achieved according to the present invention by providing an electrical connector having tail portions disposed at positions mirror symmetrical with each other around a mirror plane which is perpendicular to an extending direction of said row of tail portions and which passes through a midpoint between the connecting terminals adjacent to each other in the extending direction of said row.

In the electrical connector of this invention, since the tail portions are disposed at positions mirror symmetrical with each other around a mirror plane which is perpendicular to an extending direction of said row of said tail portions and which passes through a midpoint between the connecting terminals adjacent to each other in the extending direction of said row, the signal line tail portions in the bent and protruding tail portions aligned in a row are always positioned between the ground line tail portions, even if the two rows of connecting terminals are disposed in such a manner that the signal line terminals and the ground line terminals form a checkerboard pattern when viewed from the side of contact of each connecting terminals (the side opposite to that at which the tail portions are provided), and therefore the possibility of occurrence of crosstalk between the signal line tail portions can be reduced.

DESCRIPTION OF THE PREFERRED EMBODIMENT

Figure 1B:
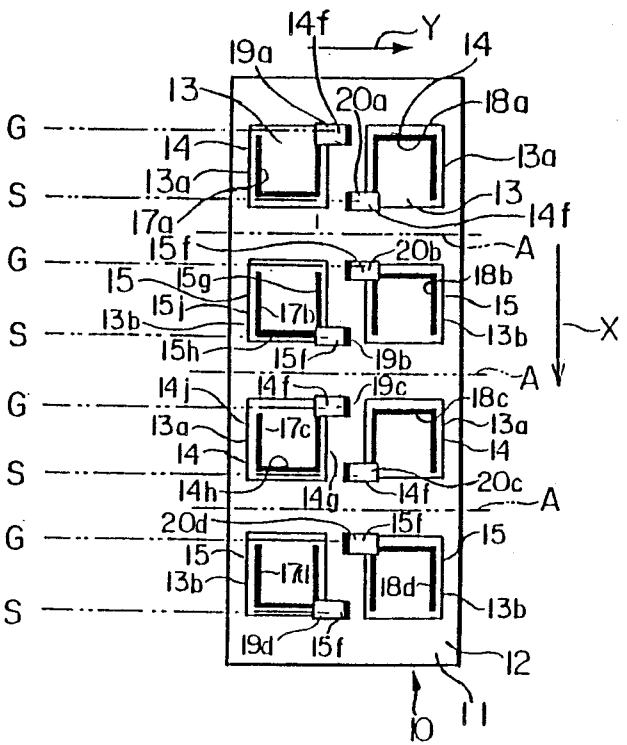
FIGS. 1A and 1B are side and front views, respectively, of a connector, showing a preferred embodiment of the present invention.

A female electrical connector 10 according to the preferred embodiment of the present invention will be described with reference to FIGS. 1 to 4 (this connector looking just like the one shown in FIG. 5, when viewed from the side for receiving pins).

A housing 11 of the electrical connector 10 is made of an electrically insulating plastic, and has substantially square column shaped through-holes 13 extending from one end surface 12 thereof to the other end surface (not shown). The through-holes 13 are the same in size and aligned in two rows at the equal spacings. More specifically, the two through-holes 13 in each pair of through-holes adjoin to each other in the direction perpendicular to the extending direction X of the through-hole rows. Each of a pair of through-holes 13*a* which are disposed alternately in the direction X of extension of each row, houses a first bent metal sheet 14, while the remaining through-holes 13*b* each accommodate a second bent metal sheet 15.

Figure 1A:
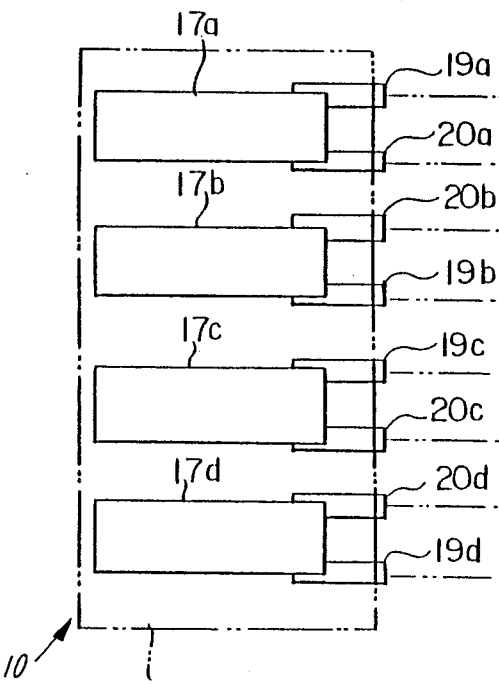
Figure 2:
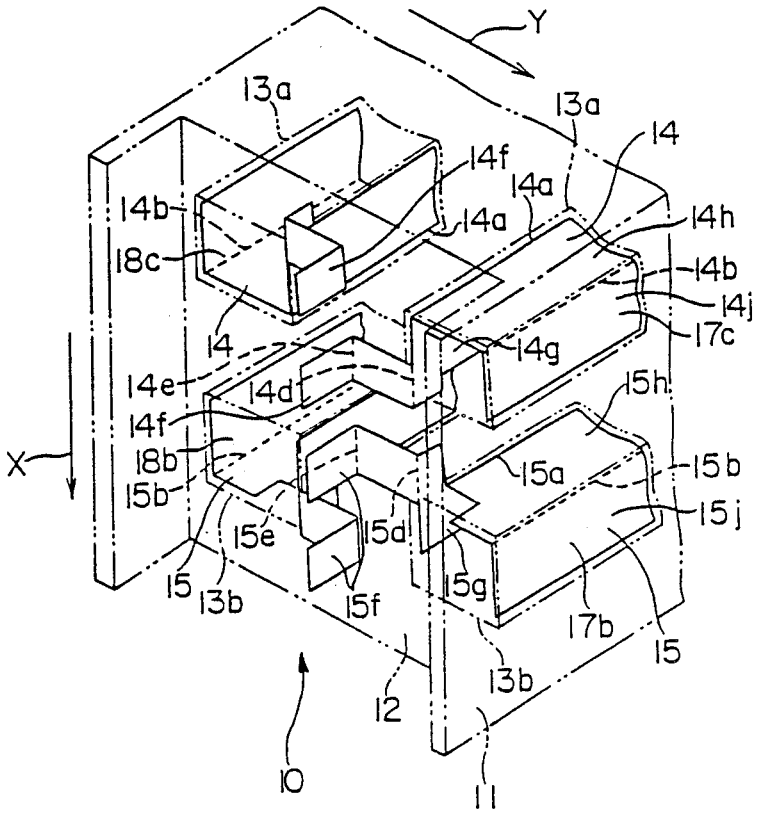
FIG. 2 is a perspective view of the connector of FIG. 1, showing the structure and the arrangement thereof.
Figure 3:
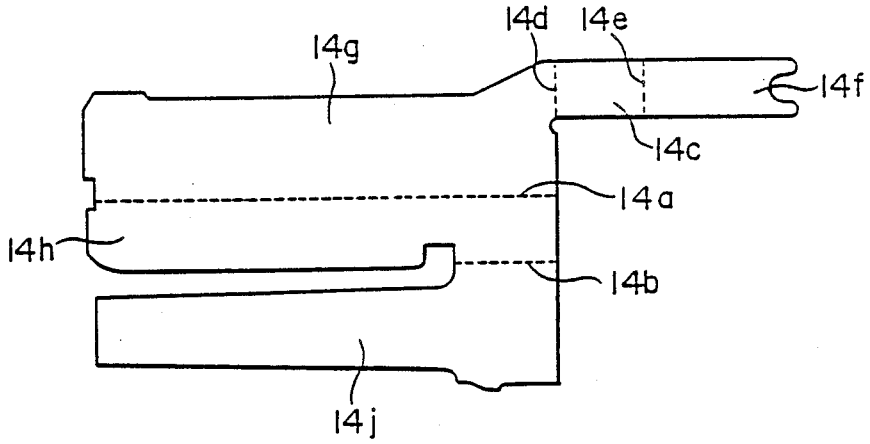
FIGS. 3 and 4 are exploded views of two types of terminal forming metal sheets which are employed in the connectors shown in FIGS. 1 and 2 and which are schematically shown in FIGS. 1 and 2, respectively.

The first bent metal sheet 14 which is schematically shown in FIGS. 1 and 2 is a metal sheet pinched into a shape shown in FIG. 3 and bent at broken lines 14*a* and 14*b* at right angles so that three side surfaces 14*g*, 14*h* and 14*j* out of four side surfaces which form a square tube constitute a female contact pressingly inserted into the corresponding through-hole 13*a*. A projection 14*c* which extends from the outer side of the end of the side surface 14*g* is bent at broken lines 14*d* and 14*e* at right angles. The projection 14*c* has a distal end or a tail portion 14*f* at which the connecting terminal is adapted to be electrically connected to a wire of a flat cable by soldering.

Figure 4:
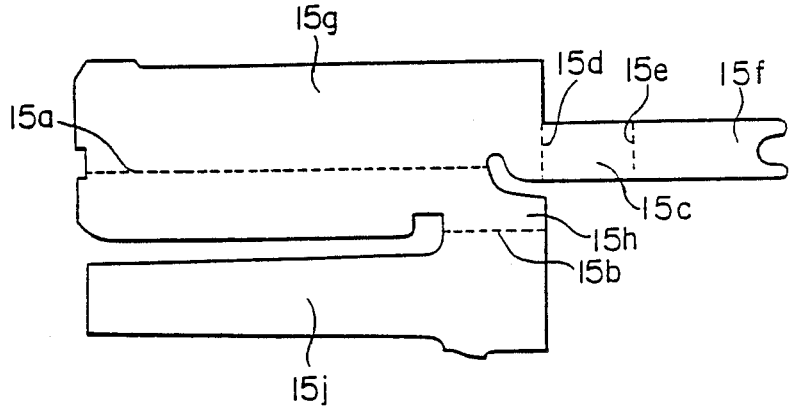
Figure 5:
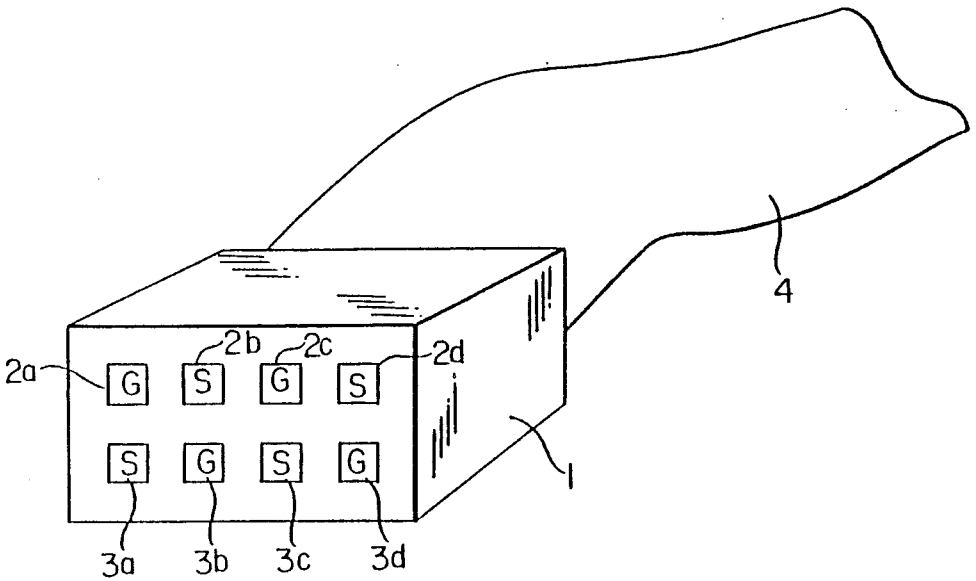
FIG. 5 PRIOR ART
FIG. 5 is a perspective view of a known female connector connected to a flat cable, as viewed from the side thereof to which pins are to be inserted.
Figures 6A, 6B:
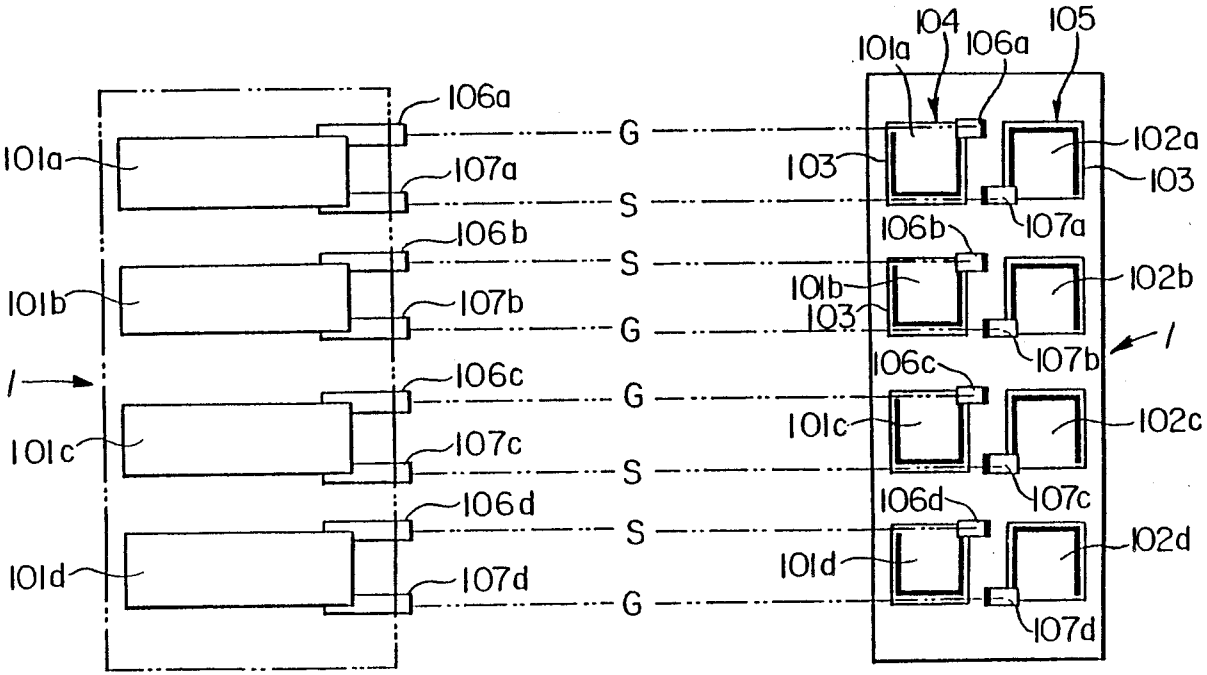
FIG. 6B PRIOR ART
FIG. 6A PRIOR ART
FIGS. 6A and 6B are views similar to FIGS. 1A and B, showing the known prior art connector of FIG. 5.
Figure 7:
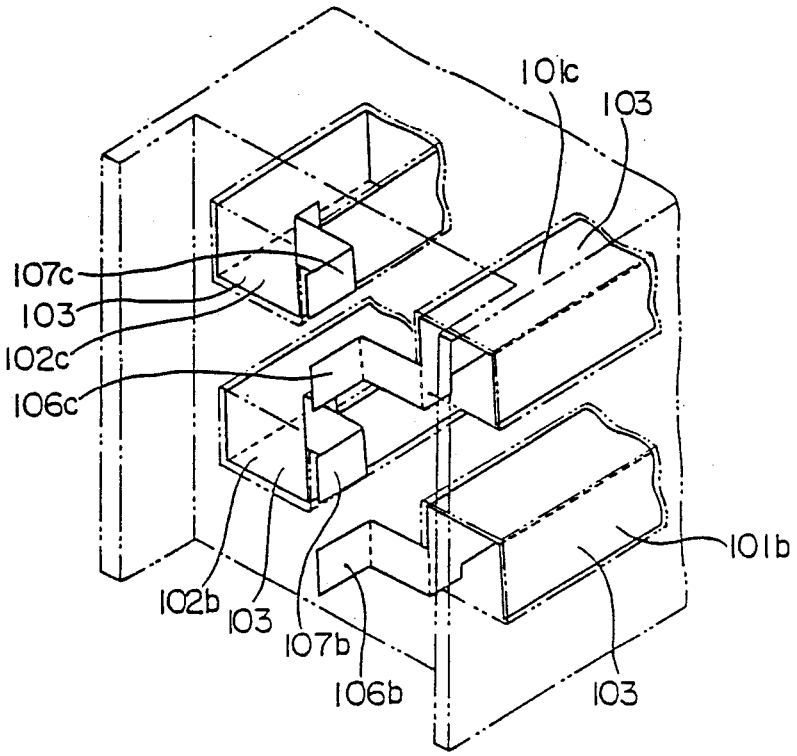
FIG. 7 PRIOR ART
FIG. 7 is a view similar to FIG. 2, showing the known prior art connector of FIG. 6.

A second bent metal sheet 15 which is schematically shown in FIGS. 1 and 2 is a metal sheet punched into a shape shown in FIG. 4 and bent at broken lines 15*a* and 15 *b* at right angles so that three side surfaces 15*g*, 15*h* and 15*j* out of four side surfaces which form a square tube constitute a female contact pressingly inserted into the corresponding through-hole 13*b*. A projection 15*c* which extends from the inner side of one end of the side surface 15*g* is bent at broken lines 15*d* and 15*e* at right angles. The projection 15*c* has a distal end or a tail portion 15*f* at which the connecting terminal is adapted to be electrically connected to a wire of a flat cable by soldering.

While the projection 14*c* of each bent metal sheet 14 projects from the outer side of the one end of the side surface 14*g*, the projection 15*c* of each bent metal sheet 15 extends from the inner side of the one end of the side surface 15*g*, ie., from the vicinity of the broken line 15*a*. Therefore, the tail portions of the bent metal sheets are positioned mirror symmetrical with each other around or about a virtual mirror plane A which is perpendicular to the X direction and passes through a midpoint between the terminals adjacent to each other in the direction X. The tail portion 15*f* of each bent metal sheet 15 is inserted into the through-hole 13*b* adjoins the tail portion 14*f* of the adjacent bent metal sheet 14 inserted into the through-hole 13*a* in the same row.

Connecting tail portions 19*a*, 19*b*, 19*c*, 19*d*; 20*a*, 20*b*, 20*c*, 20*d* of two rows of connecting terminals 17*a*, 17*b*, 17*c*, 17*d*; 18*a*, 18*b*, 18*c*, 18*d* of the connector 10 are aligned in a row. However, the tail portions 20*a*, 19*b*, 20*c*, and 19*d* for connecting signal lines do not adjoin to each other but are disposed between the corresponding tail portions 19*a*, 20*b*, 19*c*, and 20*d* for connecting ground lines. In other words, the tail portions are disposed as a whole in the order of G, S, G, S, . . . with G and S disposed alternately and at the same spacing. In consequence, the possibility of crosstalks of signals which occur at the tail portions is reached.

In additon, the tail portions which are connected to a flat cable of the like may be buried in a resin.

The connector of this invention may be connected to a coaxial ribbon cable instead of the flat cable.

The bent body which forms a terminal may have any shape instead of that shown in FIGS. 1 to 4, so long as its tail portion is placed at a location shown in the figure and that it has three or four side surfaces which constitute a contact. The bent body may have the same expanded form.

If the spacings between the through-holes 13 are large compared with the size of the through-hole 13, the tail portions may be disposed at locations which are away from the ends of the through-holes in the X direction toward the intermediate portion thereof. If the size of the through-holes for the signal lines is different or it is different from that of the through-holes for the ground lines, the tail portions may be disposed in any way so long as the alternate arrangement of the S and G is ensured.

The terminal of this connector may be male in place of female.

I claim:

1. An electrical connector having two rows of connecting terminals, each of said connecting terminals having a tail portion which protrudes from one end thereof in such a manner that the tail portions are bent and as a whole are aligned in a row, and said connector is adapted to be electrically connected to a cable by means of said tail portions, wherein said tail portions are disposed at positions symmetrical with each other about a plane which is perpendicular to the direction in which said row of tail portions extends and which passes between two said connecting terminals adjacent to each other in the extending direction of said row.

2. A connector according to claim 1, wherein the other end of each of said connecting terminals forms a female contact.

3. A connector according to claim 1 or 2, wherein each of said connecting terminals is formed by a bent metal sheet.

4. An electrical connector having two rows of connecting terminals, each of said terminals having a first end disposed in one of said rows and a second tail portion end for connection to a wire of a cable, said terminals each having a first or second configuration with each said row having alternating terminals of said first and second configurations, opposing said terminals in said rows having the same configuration.

5. An electrical connector according to claim 4, wherein said terminals are formed of conductive metal sheets of two dissimilar patterns, each said pattern having a plurality of fold lines to form a female terminal on said first terminal end and projecting said tail portions which are plane at said second ends, said tail portions being disposed in a single row.

* * * * *